US009932046B2

(12) United States Patent
Watermiller et al.

(10) Patent No.: US 9,932,046 B2
(45) Date of Patent: Apr. 3, 2018

(54) ZIP TRACK SYSTEM

(71) Applicant: Landscape Structures Inc., Delano, MN (US)

(72) Inventors: Randy G. Watermiller, Buffalo, MN (US); Steven J. Schaust, Buffalo, MN (US)

(73) Assignee: Landscape Structures Inc., Delano, MN (US)

( * ) Notice: Subject to any disclaimer, the term of this patent is extended or adjusted under 35 U.S.C. 154(b) by 81 days.

(21) Appl. No.: 14/524,298

(22) Filed: Oct. 27, 2014

(65) Prior Publication Data

US 2015/0114250 A1 Apr. 30, 2015

Related U.S. Application Data

(60) Provisional application No. 61/896,460, filed on Oct. 28, 2013.

(51) Int. Cl.

| | |
|---|---|
| ***A63G 21/20*** | (2006.01) |
| ***A63G 7/00*** | (2006.01) |
| ***B61B 7/00*** | (2006.01) |
| ***A63G 21/22*** | (2006.01) |

(52) U.S. Cl.
CPC ..... *B61B 7/00* (2013.01); *A63G 7/00* (2013.01); *A63G 21/20* (2013.01); *A63G 21/22* (2013.01)

(58) Field of Classification Search
CPC ..... A63G 21/22; A63G 21/20; A63G 7/00; B61B 7/00

(Continued)

(56) References Cited

U.S. PATENT DOCUMENTS 637,775 A * 11/1899 Funk ..... A63G 7/00 104/63
831,302 A * 9/1906 Schroeder ..... E01B 25/18 104/115

(Continued)

FOREIGN PATENT DOCUMENTS

DE 374406 C 4/1923
JP S57 67763 U 4/1982

(Continued)

OTHER PUBLICATIONS

Landscape Structure 2009—front and rear cover pages and pp. 98, 99.*

(Continued)

*Primary Examiner* — Mark T Le
(74) *Attorney, Agent, or Firm* — Kelly, Holt & Christenson, PLLC; Katherine M. Scholz

(57) ABSTRACT

Zip track systems and systems for extending zip track systems are provided. An extension mechanism for a zip track system illustratively comprises a crossover unit, configured to attach to a zip track. The crossover unit illustratively comprises a crossover arch and two crossover support poles, wherein each of the support poles connects to an end portion of the crossover arch such that the support poles are configured to stand perpendicular to the zip track. The extension system further illustratively comprises a connection mechanism configured to connect the crossover arch to the zip track system such that the crossover unit distributes the weight of the track through the crossover arch and the crossover support poles.

20 Claims, 4 Drawing Sheets

(58) Field of Classification Search
USPC ..... 104/113, 53, 93, 89, 94, 95, 123, 124, 104/125, 126; 105/148, 149.2, 150
See application file for complete search history.

(56) References Cited

U.S. PATENT DOCUMENTS

| | | | | | |
|---|---|---|---|---|---|
| 833,835 | A * | 10/1906 | Huntley | A63G 7/00 | 104/63 |
| 1,222,007 | A * | 4/1917 | McGuire | E01B 25/18 | 104/115 |
| 1,546,375 | A * | 7/1925 | Geiser | A63G 27/00 | 104/79 |
| 3,070,035 | A * | 12/1962 | Russo | A63G 21/22 | 104/113 |
| 3,327,644 | A * | 6/1967 | Black | B65G 21/22 | 104/106 |
| 4,125,908 | A * | 11/1978 | Vail | A61G 7/1015 | 104/94 |
| 4,165,695 | A * | 8/1979 | Schwarzkopf | A63G 21/04 | 104/162 |
| 4,708,048 | A * | 11/1987 | Brown | F41A 9/01 | 104/126 |
| 5,468,199 | A * | 11/1995 | Keeler | A63B 9/00 | 104/62 |
| 5,655,457 | A | 8/1997 | Sherman et al. | | |
| 5,732,635 | A * | 3/1998 | McKoy | A63G 33/00 | 104/172.3 |
| 5,860,364 | A * | 1/1999 | McKoy | A63G 33/00 | 104/292 |
| 5,904,099 | A * | 5/1999 | Danneker | B61K 7/02 | 104/115 |
| 5,931,100 | A * | 8/1999 | Sutton | A63G 21/20 | 104/53 |
| 6,629,500 | B1 * | 10/2003 | Hansen | A63G 7/00 | 104/53 |
| 7,381,137 | B2 | 6/2008 | Steele et al. | | |
| 7,823,511 | B2 | 11/2010 | Lins et al. | | |
| 2002/0162477 | A1 * | 11/2002 | Palumbo | B61B 7/00 | 104/87 |
| 2003/0217667 | A1 * | 11/2003 | Bussink | A63G 7/00 | 104/53 |
| 2011/0239898 | A1 * | 10/2011 | Brown | A63G 21/20 | 105/150 |
| 2013/0184087 | A1 | 7/2013 | Degirmenci | | |
| 2014/0116282 | A1 * | 5/2014 | Horihan | B61B 3/02 | 104/89 |

FOREIGN PATENT DOCUMENTS

| | | | |
|---|---|---|---|
| KR | 101300142 | B1 | 9/2013 |
| WO | WO 2012-145045 | A1 | 10/2012 |

OTHER PUBLICATIONS

Playworld Systems 2010 Playground and Recreation Products, pp. 1-2.*
"New York Zipline Adventure Tours", Oct. 14, 2013, retrieved at WayBack Machine <<https://web.archive.org/web/20131014181052/http://www.ziplinenewyork.com>> retrieved on Feb. 24, 2015, 2 pages.
"Navitat Canopy Adventures—Asheville Zipline", Jul. 15, 2013, retrieved at WayBack Machine <<http://web.archive.org/web/20130715001955/http://www.navitat.com/asheville-nc>>retrieved on Feb. 24, 2015, 4 pages.
"Playdale Playgrounds: Adventurous play with the aerial runway", Aug. 19, 2011, retrieved at <<http://blog.playdale.com/2011/08/adventurous-play-with-aerial-runway.html>>retrieved on Feb. 24, 2015, 2 pages.
"Playworld Systems introduces new LiveWire, Triumph Climber and PlayWeb Lite playground products", Apr. 16, 2013, retrieved at <<http://playworldsystems.com/why_playworld/about_us/press/news/playworld_systems_introduces_new_livewire_triumph_climber_and_play>>retrieved on Feb. 24, 2015, 2 pages.
International Search Report and Written Opinion for International Application No. PCT/US2014/062598, dated Feb. 10, 2015, date of filing: Oct. 28, 2014, 16 pages.
Habitat—Systems, "ZipKrooz—Playground Zipline for kids of all abilities", Apr. 10, 2015.
Accessible Playgrounds, "Inclusive play equipment: ZipKrooz Assisted", May 22, 2015.
Jenni Frankenberg, "Miracle on the Mountain Play Outside Park to provide environment for kids with disabilities", May 1, 2016.
Humana Health Insurance Company, "Inclusive Playground Design", Oct. 31, 2016.
ASTM International, "ASTM F1487-11, Standard Consumer Safety Performance Specification for Playground Equipment for Public Use", ASTM International, West Conshohocken, PA, 2011, www.astm.org.
ASTM International, "ASTM F1193-16, Standard Practice for Quality, Manufacture, and Construction of Amusement Rides and Devices", ASTM International, West Conshohocken, PA, 2016, www.astm.org.
ASTM International, "ASTM F2137-15a, Standard Practice for Measuring the Dynamic Characteristics of Amusement Rides and Devices", ASTM International, West Conshohocken, PA, 2015, www.astm.org.
ASTM International "ASTM F2291-15, Standard Practice for Design of Amusement Rides and Devices", ASTM International, West Conshohocken, PA, 2015, www.astm.org.
Canadian Office Action dated Mar. 3, 2017 for application No. 2,928,825.
Office Action for Canadian Application No. 2,928,825 dated Sep. 26, 2017, 4 pages.
European Extended Search Report for European Application No. 14858565.6 dated Aug. 31, 2017, 10 pages.
Playmore Recreational Products; "Flying Squirrel Zip Line"; 1 page submitted; Jul. 1, 2011; YouTube; https://www.youtube.com/watch?v=Wal-T0a-C8o.†
Lucky Little Travellers; Jardin du Luxembourg; 4 apges submitted; 2012; Luckylittletravelers.com; http://www.luckylittletravelers.com/kidtravelweb-paris-luxembourg-garden.html.†
Landscape Structures, inc.; 2011 Landscape Structures catalog; 1 page submitted; 2011; Landscape Systems; 2011 Landscape Systems catalog.†
Sirena Woyt; "The new playground @ Elm Creek"; 1 page submitted; Jun. 27, 2011; YouTube; https://www.youtube.com/watch?v=wmNQOkufCgl.†
Jason Amberg; "Elms Creek's Creative Play"; 8 pages submitted; Sep. 25, 2015; LandscapeOnline.com; http://www.landscapeonline.com/research/article/15419.†
Monorail; Monorail 2008 Catalog; 1 page submitted; 2008.†
Playcraft Systems; 1 page submitted; 2008, Playcraft Systems 2008 catalog.†
Miracle; 1 page submitted; 2004; 2004; Miracle catalog.†
Playworld Systems 2012 School-Age Playgrounds & Site Furnishings Catalog, pp. 108-109, 2012.†
Playcraft Systems Playground Equipment Catalog for 2007, pp. 112-113, 2007.†
Playcraft Systems Playground Equipment Catalog for 2011, p. 117, 2011.†
Playworld Systems 2010 Playground and Recreation Products catalog, p. 122, 2010.†
Miracle Recreation Equipment Company, Shaping the Future of Play catalog, pp. 118-119, 2009.†
Landscape Structures Inc., Park and Playground Equipment catalog, p. 179, 2012.†
Landscape Structures Inc., Park and Playground Equipment catalog, pp. 98-99, 2009.†

* cited by examiner
† cited by third party

ZIP TRACK SYSTEM

CROSS-REFERENCE TO RELATED APPLICATION

The present application claims the priority of provisional application Ser. No. 61/896,460, filed on Oct. 28, 2013, the content of which is hereby incorporated by reference in its entirety.

BACKGROUND

Zip lines are known in the art as a trolley or carriage running along a suspended cable allowing a rider to move from one end to the other. However, there are several known problems with these structures. The first includes the deceleration of the rider as they approach the end as well as the initial force to move the user—for example, a push from another person, or a push off from a portion of the structure. Further, the riding structures of the prior art require significant upper body strength and the ability of a user to grip and hold on with their hands, thus limiting many users from enjoying the structure.

Another series of problems arise from the cable used in a zip line. The cable requires a gradient in order to allow a user to continue propulsion from one end to another. This often limits spaces where a zip line can be installed to those with a natural gradient, or requires the creation of an artificial gradient. There is also a limitation to the maximum length of a zip line before structural soundness is compromised. Additionally, the connection between the riding structure and the cable presents some safety hazards, including the potential for the fingers of users to get caught on or around the cable.

A solution to these problems is required that provides the fun experience of a zip line without all of the hazards and limitations of the conventional design.

The discussion above is merely provided for general background information and is not intended to be used as an aid in determining the scope of the claimed subject matter.

SUMMARY

Zip track systems and extension systems are provided. An extension mechanism for a zip track system illustratively comprises a crossover unit, configured to attach to a zip track. The crossover unit illustratively comprises a crossover arch and two crossover support poles, where each of the support poles connects to an end portion of the crossover arch such that the support poles are configured to stand perpendicular to the zip track. The extension system further illustratively comprises a connection mechanism configured to connect the crossover arch to the zip track system such that the crossover unit distributes the weight of the track through the crossover arch and the crossover support poles.

These and various other features and advantages that characterize the claimed embodiments will become apparent upon reading the following detailed description and upon reviewing the associated drawings.

DETAILED DESCRIPTION OF ILLUSTRATIVE EMBODIMENTS

A safe, extendable zip track is desired where user can, in a seated position, enjoy the sensation of a conventional zip line play structure, without the limitations of such a conventional structure. Further, a zip track system is desired where an external force is not necessary for an initial movement, in order to engender more exciting, inclusive and safe, play. By introducing a track into the design, a more consistent control over the deceleration is achieved. In addition, this enables different styles of seats to be introduced into the design that allow for a safe use of the product.

Figure 1:
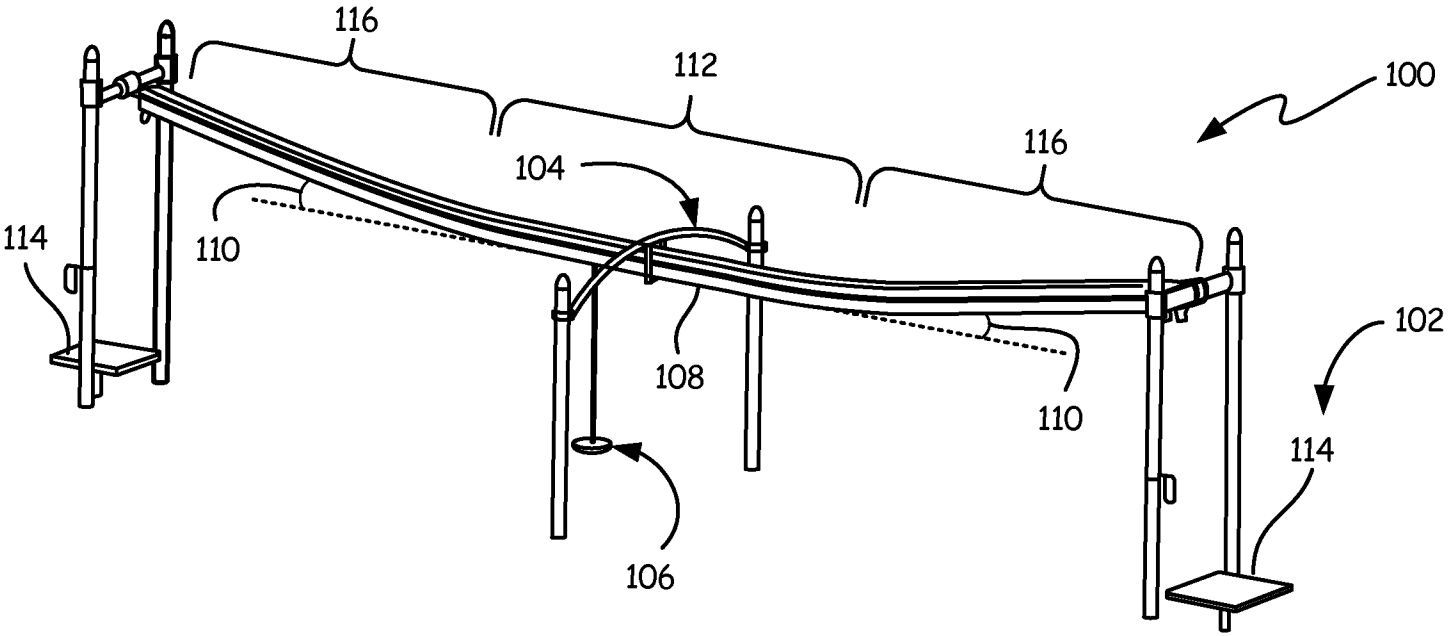
FIG. 1 is a perspective side view of a zip track system in accordance with one embodiment.

FIG. 1 is a perspective side view of a zip track system 100 in accordance with one embodiment. Zip track system 100 comprises two end platforms 102, in the illustrated embodiment. However, in another embodiment, the zip track system 100 may only have one end platform 102 or may be constructed with no end platforms 102. Zip track system 100 comprises a crossover unit 104 that is connected to the zip track system 100 at a connection point along the zip track system 100 in order to support a longer track 108 as part of the zip track system 100. Track 108 runs from the top of a first end platform 102 to a second end platform 102.

Zip track system 100 may also comprise, in one embodiment, a seat structure 106. However, in another embodiment, any structure that connects to the track 108 such that it facilitates a user's movement along the track 108 would be adequate, for example a pre-formed seat or a knotted rope structure. The seat structure 106 is configured to accommodate a user comfortably in a seated position. This allows for a larger number of users with a variety of ability levels to enjoy the zip track system 100. For example, for users that do not have sufficient motor function in their upper body and hands, a seat structure, like seat structure 106, allows such ways to still access the zip track system, for example by sitting on the seat structure 106 and wrapping their legs around the connection to hold on.

Figure 4A:
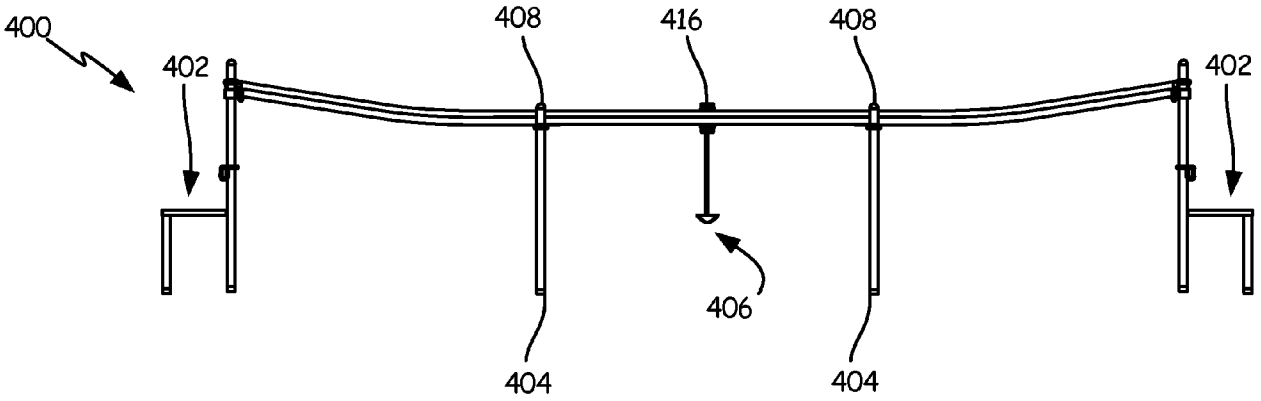
FIGS. 4A and 4B are a perspective side view and a perspective end view, respectively, of an extended zip track system in accordance with one embodiment.
Figure 4B:
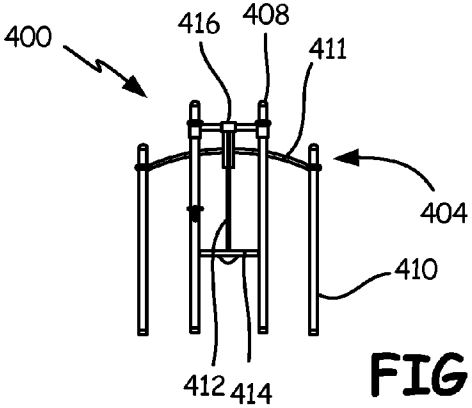

As shown in FIG. 1, track 108 comprises at least one inclined portion with incline angle 110 and a straight portion with a length 112. Track 108 preferably has two incline portions, such that a user riding on the seat structure 106, starting at one end platform 102, will go down one incline portion of track 108 across a straight portion of the track 108 and propel, by momentum gained along the first incline portion and the straight portion, back up a second incline portion of the track 108 to the second end platform 102. However, in another embodiment, track 108 could have multiple series of incline portions separated by straight portions. Additionally, in one embodiment the incline angle 110 along a first incline portion 116 is different from incline angle associated with the second incline portion 116. The end platforms 102 may also contain a raised platform 114, such that a user could stand on raised platform 114 as a departure point to ride along track 108 on the seated structure 106. This raised portion 114 ensures that the seat structure 106 does not brush the ground and otherwise damage system 100, or present a danger to a user of the system 100. In the embodiment as shown in FIG. 1, the raised portion 114 is separate from, and not connected to, the zip track system 100. However, in other embodiments, as shown in FIGS. 4A-4B below, the raised portion 114 may also be connected to the zip track system 100.

Figure 2:
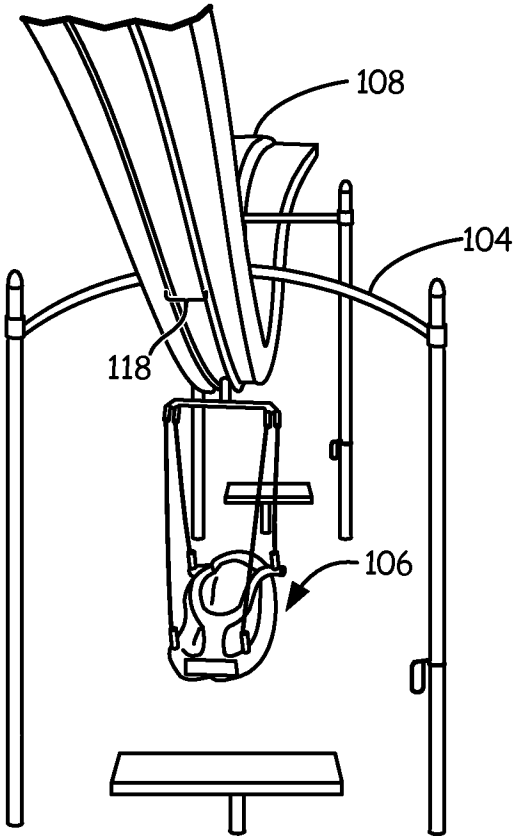
FIG. 2 is a perspective end view of a zip track system in accordance with one embodiment.

FIG. 2 presents a substantially end-on view of the zip track system 100 described above with respect to FIG. 1. Track 108 shown in FIG. 2 comprises an opening of width 118 to accommodate the movement of seat structure 106 along track 108. As shown in FIG. 2, the track curve is modest enough such that it does not present a hazard to a user, but sufficient to allow a user to gather enough momentum along the track 108 to move along the straight portion and back up a second incline portion. FIG. 2 also details another embodiment wherein the seat structure 106 comprises a safety seat that may, in one embodiment, further comprise a safety belt configuration.

Figure 3:
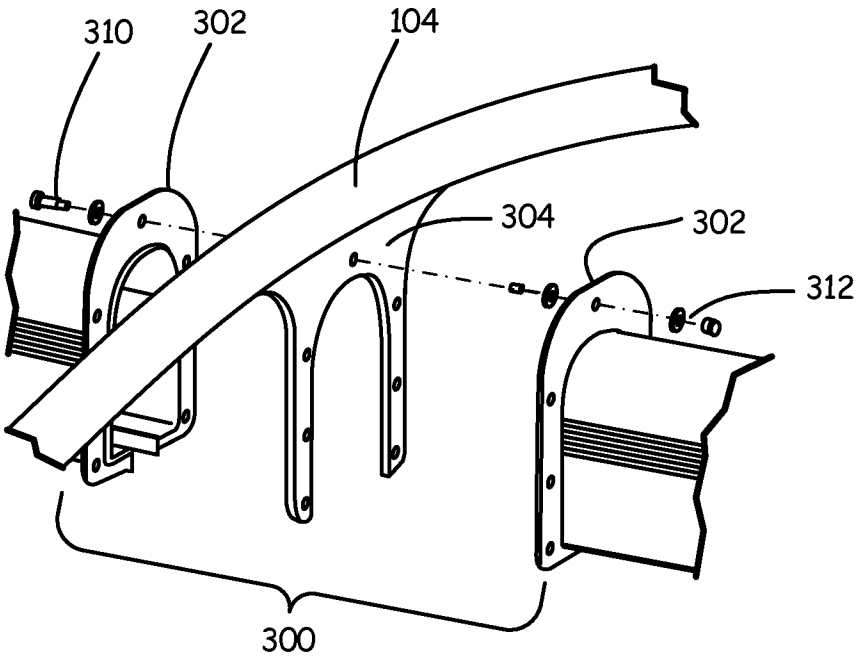
FIG. 3 is an exploded view of a track of a connection scheme of the zip track system of FIG. 1 in accordance with one embodiment.

FIG. 3 is an exploded view of a track of a connection scheme of the zip track system 100 of FIG. 1 in accordance with one embodiment. Two portions of the track 108, as shown in FIG. 3, connect to each other through and including a crossover connection 304. Each portion of a track 108 may include a track connection portion 302 at one or both ends. For example, in an embodiment comprising multiple crossover units 104, a middle section of a track 108 may include a track connection portion 302 at both a first and second end. In another embodiment, where a track 108 includes only a single crossover unit 104, each portion of a track 108 may only comprise a single track connection portion 302. A first track connection portion 302, in one embodiment, is connected on a first side of the crossover connection 304, on a receiving side. A second track connection portion 302 may be connected on a second side of the crossover connection 304, on a connection side. A connection mechanism 310 may then extend through the second track connection portion 302, through the crossover connection 304, and through the first track connection portion 304 to a connection receiving mechanism 306. In one embodiment, the connection mechanism 310 and the connection receiving mechanism 306 may be a nut and bolt, respectively. Additionally, in other embodiments, other appropriate connection mechanisms may be used to connect the track connection portions 302 to a crossover connection 304. In another embodiment, the track connections 302 and the crossover connection 304 are welded or otherwise fused together.

One limitation to conventional zip line systems has been the length of the cable. The cable length had to be limited to ensure that the support structure was strong enough to hold the weight of a user along the full length of the cable. One advantage of embodiments of zip track system 400 the ability to stretch the track system across a greater length, providing a longer play experience for a user without sacrificing the strength and safety of the structure. FIG. 4A shows how the crossover units 404 allow for the expansion of zip track system 400 to longer lengths to provide a longer ride for a user of the zip track system 400.

The crossover units 404 provide strength and structure to the system without interrupting the user experience of the zip track system 400 and, thus, allow for the system to be lengthened by placing the crossover units at regular intervals along the length of the zip track system 400. In one particular embodiment, such as the embodiment shown in FIG. 4A, these crossover units 404 are placed roughly every 200 inches to ensure that sufficient stability is provided to the zip track system 400 along its entire length. However, in another embodiment, the crossover units 404 could be placed more closely together for increased stability, or further apart, for increased length. Crossover units 404 are placed sufficiently apart on the zip track system 400 such that they provide strength and stability throughout the entire unit. These crossover units connect and engage with the zip track system 400 at crossover connection points 408.

FIG. 4A shows the zip track system 400, in accordance with one embodiment, where the zip track system 400 includes two end platforms 402 with raised structures for a user to stand on before beginning a ride, and after ending a ride on the zip track system 400. The zip track system 400 also includes a seat unit 406 that user may engage in order to ride in a safe fashion along the zip track system 400.

Conventional zip line systems have employed bars or other methods for users to hang on as they move across the system. However, this presented users with the risk of pinched fingers or risk of falling if the user ran out of strength. Additionally, for users without enough upper body strength, or an inability to use upper body strength (due to disability or other factors), conventional zip line systems were not accessible. However, the zip track system 400, shown in FIG. 4A, through the use of the seat unit 406, allows any user (with the ability to sit and hold on) to use the zip track system 400 such that they can sit on the seat unit 406 and hold on with their hands and/or legs. In another embodiment, the user can stand on the seat unit 406 and hold on with their hands. In either of these positions on the seat unit 406, the user is not required to support their entire body weight through their arms alone.

Crossover unit 404 is more clearly illustrated in FIG. 4B. The crossover unit comprises a crossover arch 411 that extends from one crossover support pole 410 to a second crossover support pole 410 and connects with the zip track system 400 at a crossover connection 408. This helps to distribute the weight of a user seated on the seat unit 406 through the crossover unit 404 such that the weight is held by the crossover support poles 410 and the crossover arch 411. In one embodiment, the crossover arch 411 is welded to the crossover support poles 410. In another embodiment, the crossover arch 411 is fastened to the crossover support poles 410 such that the crossover unit 404 can be dismantled. For example, in one embodiment the crossover arch 411 is screwed to the crossover support poles 410. In another example, the crossover arch 411 is attached to the crossover support poles 410 with a nut and bolt configuration.

In one embodiment, the crossover connection 408 comprises welding the crossover unit 404 to the track at the center of the crossover arch 411. In another embodiment, the crossover connection 408 comprises a screw system or a nut and bolt structure to connect the crossover arch to the zip track system 400. Additionally, any other suitable connection mechanism that sufficiently attaches the crossover connection 408 to the zip track system 400 such that the weight of the track and any potential user is distributed through the crossover arch 411 and support poles 410 would be adequate.

While FIGS. 4A and 4B show a zip track system 400 with only two crossover units 404, in another embodiment a zip track system 400 could comprise three crossover units 404, providing an even longer play structure for a user. However, the zip track system 400 is not limited to three crossover units 404, but could comprise five, ten, or more, crossover units 404, such that the system could be as long (or short) as desired by a purchaser/user of the system.

Additionally, while FIGS. 1-4 show a track system that runs in a substantially straight line, an additional embodiment comprises a zip track system with a curve or a turn, providing a means for compacting the play experience within an enclosed area that would not accommodate an equivalent length zip track to run in a straight line.

In a further embodiment, instead of inclined portions alternating with straight portions of track, the zip track system 400 could comprise a substantially curved track 408 such that there are no straight portions, but a curved track that substantially alternates an inclined down portion and an inclined up portion. However, in such an embodiment, the inclined portions are configured to alternate in such a way that a user is not jolted from the inclined down portion to the inclined up portion to avoid a jolt to a user of the zip track system 400. Additionally, in one embodiment the track 408 is configured to accommodate sway by a user on the seating structure caused by centripetal force as a user moves along the curved track.

Figure 5:
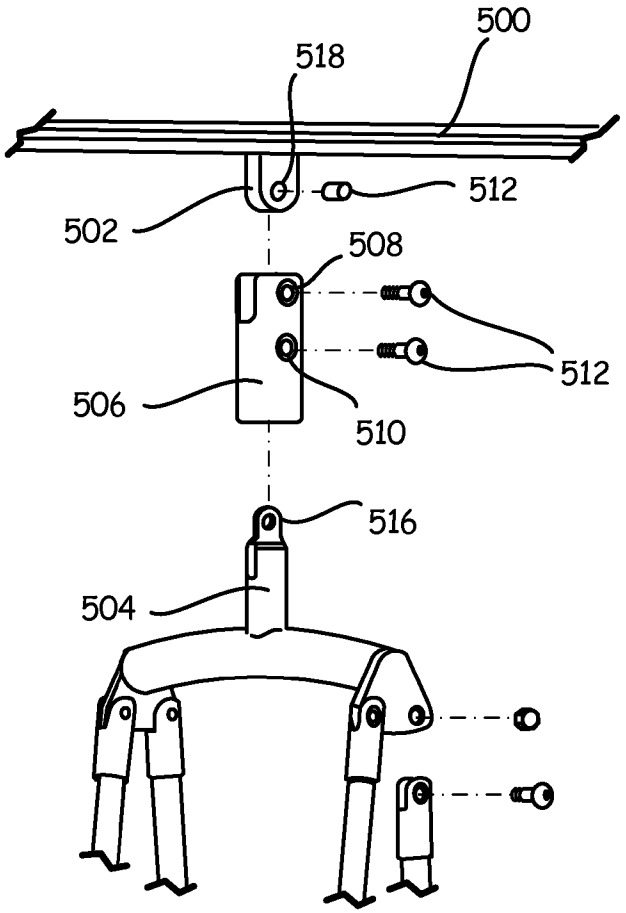
FIG. 5 is an exploded view of a track connection mechanism of the zip track system of FIG. 1 in accordance with one embodiment.

FIG. 5 is an exploded view of a track connection mechanism of the zip track system 100 of FIG. 1 in accordance with one embodiment. In one embodiment, a trolley 502 sits on a track 500 such that a portion of the trolley 502 is within the track 500, for example as shown in the end view of FIG. 2. In one embodiment, trolley 502 connects to a seat structure 504 through a connecting portion 506. However, in another embodiment, the trolley 502 connects directly to a seat structure 504. In the embodiment including a connection structure 506, the trolley 502 connects through a trolley connection 518 at a trolley connection point 508, while the seat structure 504 connects through a seat connection 516 at a seat connection point 510. Connection mechanisms 512 are used to connect the trolley 502 and the seat structure 504 to the connecting portion 506. In one embodiment, the connection mechanisms 512 may be screws. In another embodiment, the connection mechanism 512 may comprise a nut and bolt configuration or any other appropriate connection mechanism.

Although the present invention has been described with reference to preferred embodiments, workers skilled in the art will recognize that changes may be made in form and detail without departing from the spirit and scope of the invention.

What is claimed is:

1. A track system for installation within a playground, the track system comprising:

a first end comprising a first axis defined by a first pole and a second pole;

a second end comprising a second axis defined by a third pole and a fourth pole, wherein the first axis and second axis are parallel;

a track running perpendicular to each of the first and second ends, and extending between the first and second ends, the track comprising:

a downward incline portion;

a straight portion;

an upward incline portion; and wherein the first end connects to the downward incline portion, the downward incline portion connects to the straight portion, the straight portion connects to the upward incline portion, and the upward incline portion connects to the second end;

a trolley configured to travel along an underside of the track, between the first end to the second end, wherein movement of the trolley is driven primarily by a momentum gained by traveling down the downward incline portion, with substantially no external drive mechanism;

a U-shaped crossover connection mechanism located along a length of the track, between the first end and the second end, wherein the crossover connection mechanism is configured to support a portion of a weight of the track system;

wherein the crossover connection mechanism is configured to couple to a flange of the track through a bolt connection utilizing a bolt hole in the crossover connection mechanism;

wherein the crossover connection mechanism is configured to couple to a fifth pole and a sixth pole, wherein the fifth and sixth poles are on opposing sides of, and offset from, a length of the track; and a seat mechanism, wherein the seat mechanism is coupled to the trolley, and wherein the seat mechanism is configured to travel underneath the connection mechanism, between the fifth and sixth poles.

2. The track system of claim 1, wherein the crossover connection mechanism comprises an arch.

3. The track cable system of claim 2, wherein a plurality of extension mechanisms are connected to the track at regularly spaced intervals between the first end and the second end.

4. The track system of claim 1, and further comprising a raised platform at the first end, positioned substantially between the first pole and the second pole.

5. A zip track system configured for installation within a playground environment, the zip track system comprising:

a first end and a second end, wherein each of the first end and the second end are configured to be perpendicular to a ground of the playground environment;

a track that extends from the first end and the second end;

a trolley configured to move along the track between the first end and the second end, wherein the trolley is configured to couple to the track such that a portion of the trolley is within the track, and wherein the trolley is configured to be propelled by momentum gained along an inclined portion of the track; and an extension system configured to support a portion of a weight of the track, comprising:

a crossover unit configured to connect to a flange of an end portion of a subsection of the track such that the crossover unit is substantially perpendicular to the track;

a first crossover support pole coupled to the crossover unit at a first point, and perpendicular to the ground at a first ground point;

a second crossover support pole coupled to the crossover unit at a second point, and perpendicular to the ground at a second ground point; and wherein the first and second crossover support poles substantially face each other on opposing sides of the track, and wherein the trolley is configured to travel between the first and second crossover support poles.

6. The zip track system of claim 5, and further comprising a plurality of extension systems spaced substantially evenly apart between the first end and the second end.

7. The zip track system of claim 5, wherein the trolley is configured to couple to a seat structure configured to travel between the track and the ground.

8. The zip track system of claim 5, wherein the inclined portion comprises a first inclined portion, and wherein the track also comprises a second inclined portion and a straight portion located between the first end and the second end, such that the trolley travels down the first inclined portion, across the straight portion, and up the second inclined portion.

9. The zip track system of claim 8, wherein one of the first and second ends comprises a raised platform.

10. The zip track system of claim 9, wherein the first end comprises a first end pole and a second end pole, wherein the first and second end poles are on opposing sides of the raised platform.

11. The zip track system of claim 10, and wherein a distance between the first crossover support pole and the second crossover support pole is greater than a distance between the first and second end poles.

12. The zip track system of claim 5, wherein the track comprises a first portion and a second portion, wherein the first portion and the second portion are each coupled to the crossover unit.

13. The zip track system of claim 5, wherein the crossover unit comprises an arch.

14. The zip track system of claim 5, wherein the trolley is propelled by gravitational forces such that the zip track system requires no external power generation system.

15. A zip track system for installation within a playground, the zip track system comprising:

a first track segment;

a second track segment coupled to the first track segment at a coupling point, wherein the coupling point is a bolted connection between a flange of the first track segment and a flange of the second track segment;

wherein the first and second track segments comprise a bend such that each section has an incline portion and a straight portion; and a trolley configured to move along the first and second track segments, wherein, coupled to the trolley, is a seat structure.

16. The zip track system of claim 15, and further comprising:

a crossover support, coupled to the coupling point, wherein the crossover support comprises an arch extending substantially perpendicularly to the first track segment.

17. The zip track system of claim 16, wherein the crossover support comprises a crossover connection configured to receive a plurality of bolts of the bolted connection.

18. The zip track system of claim 17, wherein the crossover connection comprises a U-shape.

19. The zip track system of claim 18, wherein the crossover connection U-shape extends along a height dimension of the track.

20. The zip track system of claim 15, wherein the straight portion is shorter than the incline portion, such that the first and second track segments when coupled together are a curved shape.

* * * * *